US007686595B1

(12) United States Patent
Graham

(10) Patent No.: US 7,686,595 B1
(45) Date of Patent: Mar. 30, 2010

(54) DIAPHRAGM PUMP

(76) Inventor: Stephen Graham, 425 Appian Way, El Sobrante, CA (US) 94803

( * ) Notice: Subject to any disclaimer, the term of this patent is extended or adjusted under 35 U.S.C. 154(b) by 514 days.

(21) Appl. No.: 11/301,011

(22) Filed: Dec. 12, 2005

(51) Int. Cl.
*F04B 17/00* (2006.01)

(52) U.S. Cl. ..... 417/413.1

(58) Field of Classification Search ..... 92/168, 92/96, 98 R, 99; 417/386–388, 395, 571, 417/413.1, 472, 412
See application file for complete search history.

(56) References Cited

U.S. PATENT DOCUMENTS

| | | | | | |
|---|---|---|---|---|---|
| 2,575,398 | A | * | 11/1951 | Schroeder | 417/571 |
| 3,867,963 | A | * | 2/1975 | Ballard | 138/46 |
| 4,020,700 | A | * | 5/1977 | Lopiccolo et al. | 73/504.06 |
| 4,035,107 | A | * | 7/1977 | Kesten et al. | 417/310 |
| 4,046,159 | A | * | 9/1977 | Pegourie | 137/112 |
| 4,231,287 | A | * | 11/1980 | Smiley | 92/94 |
| 4,666,378 | A | * | 5/1987 | Ogawa | 417/571 |
| 5,246,351 | A | * | 9/1993 | Horn et al. | 417/387 |
| 5,364,234 | A | * | 11/1994 | Eickmann | 417/273 |
| 5,950,523 | A | * | 9/1999 | Reynolds | 92/98 R |
| 2004/0071572 | A1 | * | 4/2004 | Greter | 417/413.1 |

FOREIGN PATENT DOCUMENTS

EP 950815 A2 * 10/1999

OTHER PUBLICATIONS

Bob Agnew, "Wilden Pumps" 1997, http://web.archive.org/web/19970614101415/www.iglou.com/pitt/wil4.htm.*
ABB pump manual "Continuous Gas Analyzers . . . ", 2003, p. 19.*

* cited by examiner

*Primary Examiner*—Devon C Kramer
*Assistant Examiner*—Christopher Bobish
(74) *Attorney, Agent, or Firm*—Howard Cohen

(57) ABSTRACT

A high pressure metering pump employs a flexible diaphragm extending radially from a piston as the moving pump element. The diaphragm is secured by an annular anvil at its periphery to form a high pressure seal, and the center of the diaphragm is driven reciprocally by a mechanically driven piston. A support assembly for the diaphragm includes a moveable metal ring concentric about the piston and an elastic, resilient ring concentric about the piston and interposed between the metal ring and the diaphragm. The elastic resilient ring is formed of a material such as neoprene, Viton, or the like to mediate and distribute the force between the diaphragm and the metal ring. This assembly allows the diaphragm membrane to support the high pressures that are prevalent in HPLC.

10 Claims, 1 Drawing Sheet

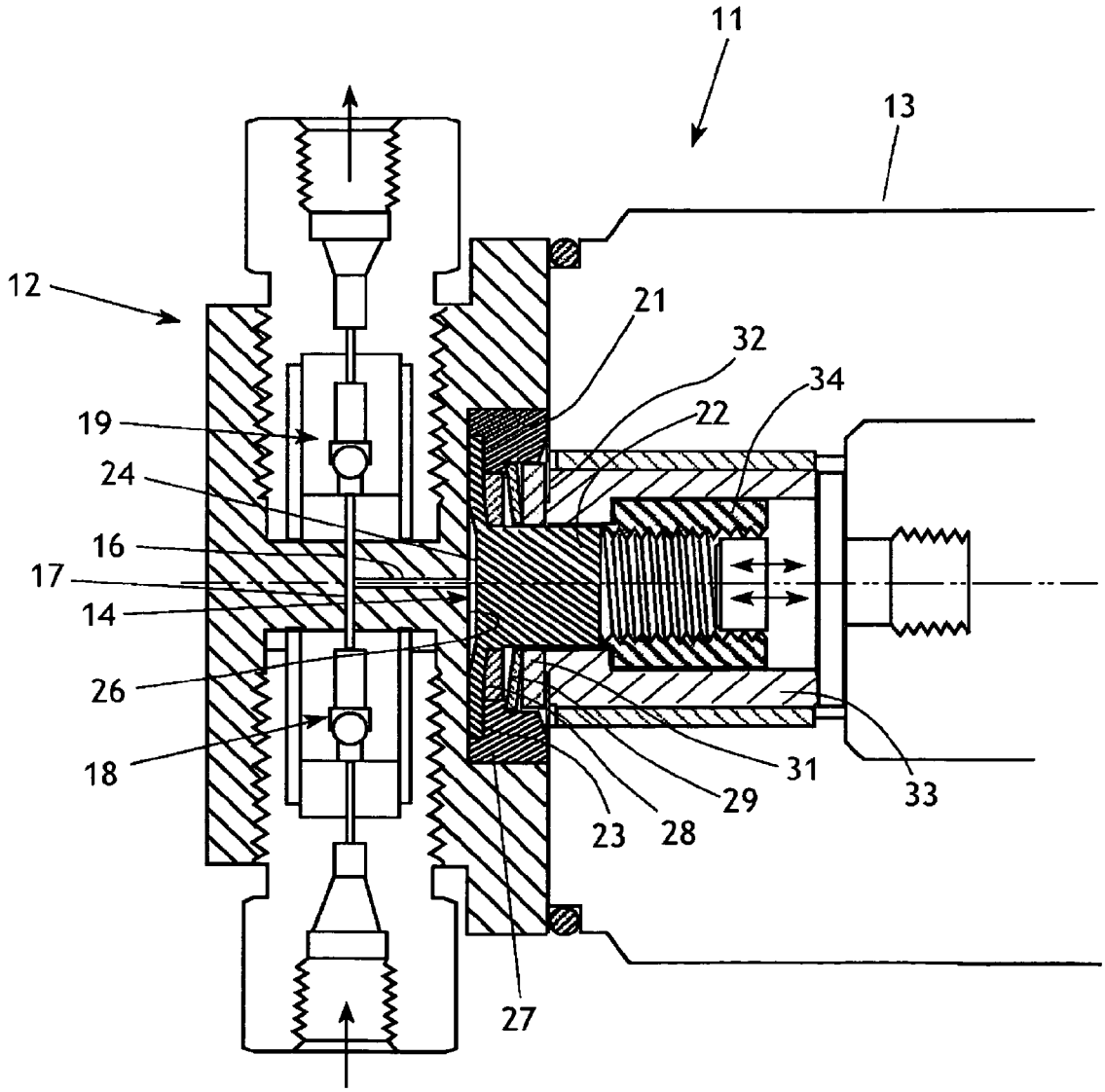
11
13
12
21
32
34
22
19
24
16
17
14
26
18
31
29
33
23
28
27

DIAPHRAGM PUMP

CROSS-REFERENCE TO RELATED APPLICATIONS

None

FEDERALLY SPONSORED RESEARCH

Not applicable.

SEQUENCE LISTING, ETC ON CD

Not applicable.

BACKGROUND OF THE INVENTION

1. Field of the Invention

This invention relates to high pressure metering pumps for primary use in laboratory analysis routines.

2. Description of Related Art

In laboratory analysis equipment such as high pressure liquid chromatography (HPLC), a fundamental requirement for successful analysis is a metering pump that can deliver extremely high pressure (several thousand psi) and at a very small (microliters/minute), reliably constant flow rate. Of course, the pumping equipment must be completely free of any potential for contaminating the solvent used in the HPLC run. This solvent may often comprise a corrosive liquid; as a result, the materials that form the pump surfaces contacting the solvent must be chosen with great care.

Typically, high pressure metering pumps use a movable piston and dynamic seal to provide positive displacement flow. The disadvantage of this arrangement is that the seals generate wear material, especially as the piston wears out, an especially severe problem when running buffers, or salt solutions (very common). This wear material not only damages downstream hydraulic components, but also clogs the inlet and outlet check valves. Thus the number one and two problems in HPLC instrumentation are valve failure and seal failure.

One state of the art metering pump uses a stainless steel diaphragm that acts as sealing barrier, with pressurized oil on the pumping side of the diaphragm to support the high pressures. A notable failure point of this type of construction is the diaphragm, due to the finite fatigue life of a thin metal member that is experiencing continuous flexure under high stress, and eventually it will fail and allow the backup oil to leak into the chromatography solvent stream and destroy sensitive hydraulic components such as the column. Another disadvantage is the added complexity of this arrangement: it requires another pumping piston and seal to pressurize/depressurize the oil behind the diaphragm. In some other prior art metering pumps, there is no backup provision of any kind to support the diaphragm, causing the diaphragm to experience the maximum pressure differential across its thin, flexible, widespread extent. This factor inherently limits the pump output pressure in such devices to less than a few hundred psi.

BRIEF SUMMARY OF THE INVENTION

The present invention generally comprises a high pressure metering pump that employs a diaphragm extending radially from a piston as the moving pump element. The diaphragm is secured by an annular anvil at its periphery to form a high pressure seal, and the center of the diaphragm is driven reciprocally by the mechanically driven piston. The diaphragm is concave and the concave side of the diaphragm, together with an opposed fixed interior surface, defines a pump chamber that communicates with a flow passage leading to a pair of inlet/outlet check valves that supply liquid at low pressure and discharge the liquid at high pressure to an end user, such as an HPLC column.

The pump assembly further provides a support assembly for supporting the diaphragm in opposition to the high pressure liquid in the pump chamber. A moveable metal ring such as a Belleville spring is disposed concentrically about the piston to support the diaphragm material and prevent extruding or cold flow while under high pressure. The assembly also includes an elastic, resilient ring disposed concentrically about the piston and interposed between the metal ring and the diaphragm. The elastic ring is formed of a material such as neoprene, Viton, or the like, and acts like the oil backup fluid employed in prior art pumps. That is, the elastic resilient material mediates and distributes the force of the diaphragm as it is applied to the metal ring, so that support is generally uniform across the radial and angular extend of the diaphragm, and stress concentrations are minimized. This assembly allows the diaphragm membrane to support the high pressures that are prevalent in HPLC.

Also, the diaphragm displacement is extremely small to allow for high frequency operation. This reduces pressure pulsations that are a major disadvantage of piston pumps. Furthermore, the diaphragm can be made to compress completely against the fixed interior surface of the pumping chamber and "bottom out", eliminating any dead volume in the head at top dead center.

This increases pump volumetric efficiency, which is critical for accurate flow rates at high pressure since solvent compressibility is often unknown and can not be compensated for in many cases with prior art piston pumps. It is noted that piston pumps cannot be designed to bottom out completely since the piston is fragile sapphire or ceramic and must have end clearance to prevent shattering the piston or the head. In contrast, the diaphragm pump of the invention features a resilient diaphragm undergoing a very small displacement, and contact between the diaphragm and the fixed wall of the pumping chamber does not engender any potential for damage to these components.

It is well recognized that pump efficiency=1−PSX/V, where:

P=system pressure

V=pump stroke volume (displacement)

X=solvent compressibility

S=pump head dead volume

Thus making pump head dead volume S equal to zero makes for high efficiency.

BRIEF DESCRIPTION OF THE DRAWING

The FIGURE is a cross-sectional view of the diaphragm pump assembly of the invention.

DETAILED DESCRIPTION OF THE INVENTION

The present invention generally comprises a high pressure metering pump for pumping liquid at very high pressure, low flow rates for uses such as HPLC and the like. With regard to the FIGURE, the diaphragm pump 11 includes a pump head 12 joined to a pump body 11 The pump head includes a pump chamber 14 that is in flow communication with a flow passage 16 that leads to flow passage 17. A check valve 18 feeds liquid under low pressure to the passage 17, and check valve 19 delivers liquid under high pressure from the pump chamber 14. The head 12 includes a bore 21 that is disposed coaxially to the passage 16. A piston 22 extends into the bore 21, and is provided with a diaphragm 23 extending radially and integrally from the distal end thereof. The diaphragm 23 is slightly concave, whereby the pump chamber 14 is defined by the concave portion 24 of the diaphragm 23 and the opposed flat interior end surface 26 of the bore 21 that is adjacent to the flow passage 16.

The diaphragm 23 is secured by an annular anvil 27 that is provided with a circular inset at the distal end thereof to receive the thickness of the diaphragm and clamp it to the surface 26 of the bore 21. The anvil is dimensioned to be a close tolerance fit in the bore 21. The distal end of the body 13 abuts the proximal end of the anvil 27 to secure it in the bore and assure a high pressure seal between the diaphragm and the surface 26. The piston and diaphragm are formed integrally of a resilient, elastic material such as a polymer that is also inert with respect to the solutions and solvents being pumped. An annular bushing 28 is secured about the piston 22 and dimensioned to impinge on the proximal (dry) side of the diaphragm 23. The impingement of the bushing 28 on the diaphragm 23 extends radially from the root of the diaphragm at the piston 22 to the outer periphery of the diaphragm that is clamped by the anvil in the bore. Thus the entire moving portion of the diaphragm 23 is contacted and supported by the bushing 28. The bushing 28 is fabricated of an elastic resilient material such as Neoprene, or Viton, or the like.

Also secured about the piston 22 is a high strength metal ring 29 such as a Belleville spring that is disposed to impinge on the proximal end of the bushing 28. A drive ring 31 is secured about the piston and disposed to impinge on the ring 29, and is held in place by a spring washer 32. The proximal end of the piston 22 is mounted within an outer drive sleeve 33 that supports an inner elastic bushing 34. A reciprocal drive rod (not shown) is threaded into the drive sleeve to impinge directly on the proximal end of the piston to translate the piston reciprocally. In addition, the drive rod applies axial force to the drive sleeve 33 through the resilient bushing 34, with the following effect.

When the drive rod translates distally (to the left in the FIGURE), the piston is driven directly to translate to the left, collapsing the pump chamber 14. At the same time, the drive ring 31 is urged distally by the sleeve 33, pushing the Belleville spring 29 against the resilient bushing 28. The force transmitted to the diaphragm 23 is thus opposed to the high pressure liquid within the pumping chamber, whereby the diaphragm is fully supported. That is, the elastic resilient material of bushing 28 mediates and distributes the force of the diaphragm 23 as it is applied to the metal ring 29, so that support is generally uniform across the radial and angular extend of the diaphragm 23, and stress concentrations are minimized. This assembly allows the diaphragm membrane to support the high pressures that are prevalent in HPLC and the like.

When the drive rod translates proximally, the diaphragm is drawn to the right in the FIGURE, expanding the pump chamber 14 and drawing in liquid from the low pressure check valve 18. The resilient bushing 28 expands axially as the deflected spring washer 32 returns proximally and urges the drive sleeve 33 proximally. The assembly is thus set to reiterate the cycle, indefinitely.

The diaphragm displacement is extremely small, which makes feasible a high frequency operating mode. This feature reduces pressure pulsations compared to the output of prior art piston pumps that operate at a relatively slow rate (1-20 pulses/sec). The pump of the present invention, in contrast, can operate in the range of 20-100 pulses/sec. The higher frequency pressure variations are more well suited to approximating a constant output pressure, since they are lower in amplitude and more easily attenuated by the system's volumetric capacity.

The diaphragm arrangement of the invention also yields an optimal pumping efficiency, due to the fact that it is capable of being driven so that resilient diaphragm impinges directly on the opposed pump cavity surface, in effect "bottoming out" against the opposed fixed interior pump surface. This feature eliminates any dead volume in the chamber at top dead center, and results in an enhanced pump efficiency that is critical for accurate flow rates at high pressure.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A high pressure metering pump, including:

a flexible diaphragm having a concave interior surface and a convex exterior surface;

a rigid flat planar surface disposed in opposition to said concave interior surface, said rigid flat planar surface extending across the entire extent of said concave interior surface and forming therebetween a pump chamber;

means for connecting a low pressure inlet check valve and a high pressure outlet check valve to said pump chamber;

piston means for driving said diaphragm reciprocally toward said rigid flat surface and compress said pump chamber to generate high pressure therein;

means for securing the peripheral edge portion of said diaphragm in sealing fashion with said rigid flat planar surface of said pump chamber, said diaphragm having an annular portion spanning between said piston means and said means for securing the peripheral edge portion;

mechanical support means for supporting said convex exterior surface of said diaphragm against the high pressure within said pump chamber;

said mechanical support means including an annular bushing disposed concentrically about said piston means and impinging continuously on the entire radial and angular extent of said convex exterior surface of said annular portion of said diaphragm, said bushing being formed of an elastic resilient material;

further including a high strength metal ring disposed concentrically about said piston means and impinging directly on the radial extent of said annular bushing to support said annular bushing and said convex exterior surface of said annular portion of said diaphragm against the high pressure generated in said pump chamber.

2. The high pressure metering pump of claim 1, wherein said piston means includes a piston formed integrally with said flexible diaphragm.

3. The high pressure metering pump of claim 2, further including a drive ring extending concentrically about said piston means and impinging on said high strength metal ring.

4. The high pressure metering pump of claim 3, further including a drive sleeve resiliently coupled to said piston means, said drive sleeve impinging on said drive ring, whereby when said piston means urges said diaphragm toward said rigid flat surface to compress said pump chamber, said drive sleeve urges said drive ring and said high strength metal ring to impinge on said annular bushing and support said convex exterior surface of said diaphragm.

5. The high pressure metering pump of claim 1, further including a pump bore having an inner end wall, said rigid flat surface comprising said inner end wall of said bore.

6. The high pressure metering pump of claim 5, wherein said means for securing the peripheral edge portion includes an anvil extending annularly in said pump bore and disposed to secure the peripheral edge portion of said diaphragm in said pump bore in sealing fashion.

7. The high pressure metering pump of claim 3, wherein said high strength metal ring comprises a Belleville spring.

8. The high pressure metering pump of claim 1, wherein said diaphragm is adapted to permit said concave interior surface to contact said rigid flat surface on each stroke of said pump, whereby the residual volume of said pump chamber is minimized.

9. The high pressure metering pump of claim 8, wherein said residual volume of said pump chamber is approximately zero.

10. The high pressure metering pump of claim 2, wherein said piston and diaphragm are formed of an elastic, resilient material that is inert with respect to the liquid flowing through said pump.

* * * * *